US006318304B1

(12) United States Patent
Teschner

(10) Patent No.: US 6,318,304 B1
(45) Date of Patent: Nov. 20, 2001

(54) WATER HEATER

(75) Inventor: Karl-Heinz Teschner, Moorabbin (AU)

(73) Assignee: Aqua Max PTY LTD (AU)

( * ) Notice: Subject to any disclaimer, the term of this patent is extended or adjusted under 35 U.S.C. 154(b) by 0 days.

(21) Appl. No.: 09/710,469

(22) Filed: Nov. 9, 2000

(30) Foreign Application Priority Data

Nov. 11, 1999 (AU) ..... PQ3980

(51) Int. Cl.[7] ..... F22B 5/00

(52) U.S. Cl. ..... 122/18.1; 122/18.4; 122/19.2; 122/494

(58) Field of Search ..... 122/13.01, 18.1, 122/18.4, 18.5, 19.1, 19.2, 494

(56) References Cited

U.S. PATENT DOCUMENTS 2,263,031 * 11/1941 Estes ..... 122/19.2
2,506,336 * 5/1950 Bock ..... 122/18.1
5,415,133 * 5/1995 Noh ..... 122/18.4

FOREIGN PATENT DOCUMENTS

A-38573/93 12/1993 (AU) .
720062 5/2000 (AU) .

* cited by examiner

*Primary Examiner*—Jiping Lu
(74) *Attorney, Agent, or Firm*—Leonard Bloom

(57) ABSTRACT

The water heater includes a water tank, a burner below the tank, a casing around the outside surface of the tank and spaced therefrom so as to define a flue path within the casing and along the outside surface of the tank for combustion products. Multiple flow restrictions are located in the flue path and extending inwardly from the casing towards the outside surface of the tank and forming regions of restricted flow area so that the combustion products flowing along the flue path encounter the flow restrictions and are restricted and disturbed in flow pattern. The first flow restriction which is first encountered by the combustion products is located at a position along the height of the tank no lower than one third of the overall height of the tank up from the bottom of the tank whereby the lower portion of the tank over which combustion products are flowing are substantially completely exposed to the hottest and most turbulent combustion gases. The flow restrictions can be closed rings which extend inwardly from the casing. The flow restriction rings have tank centering formations in the form of projections which contact the outside surface of the tank so as to thereby locate and maintain the tank centered within the casino. Each of the flow restrictions restricts the flow area of the flue path at the flow restriction by about 50% or more.

12 Claims, 1 Drawing Sheet

WATER HEATER

FIELD OF THE INVENTION

This invention relates to water heaters, such as water heaters for domestic or commercial applications, and boilers e.g. for hydronic heating systems and the like.

BACKGROUND OF THE INVENTION

One known type of water heater provides a water tank and a burner located below the tank arranged so that combustion products from the burner are directed to flow up the sides of the tank to thereby heat the water in the tank. The tank is mounted and centred within a casing so as to define a flue path for the combustion products between the outside surface of the tank and the casing. An example of this kind of water heater is shown in the present assiginee's Australian patent specification No. AU-28685/97 (Patent No. 720,062).

A problem or difficulty with this kind of arrangement is that the heat extraction efficiency may not be optimised and, in particular, combustion products may still have some significant heating capacity after being wastefully discharged from the unit.

Another kind of water heater, such as shown in Australian patent specification AU-38573/93, uses a flue for combustion products passing vertically through the centre of the water tank. The flue is provided with convolutions and baffles intended to improve the heat extraction efficiency. It would be possible to use convoluted shapes and baffles along the outside of the tank of the kind shown in our patent specification AU-28685/97 but this would be complicated and undoubtedly very costly to manufacture and assemble.

OBJECT OF THE INVENTION

It is an object of the present invention to provide a water heater enabling an improvement in efficiency of heat extraction from combustion products.

SUMMARY OF THE INVENTION

According to the present invention there is provided a water heater including a water tank having an outside surface and a lower portion thereof, a burner producing hot combustion products located at or towards the lower portion of the tank, a casing around at least part of the outside surface of the tank and spaced therefrom so as to define a flue path within the casing and along the outside surface of the tank whereby combustion products can flow along the outside surface of the tank and can therefore heat water within the tank the water heater further including at least one flow restriction located in the flue path and extending inwardly from the casing towards the outside surface of the tank and forming in generally horizontal section through the flue path a region of restricted flow area whereby the combustion products flowing along the flue path encounter the flow restriction and are restricted and disturbed in flow pattern at said at least one flow restriction, the or each one of said at least one flow restriction being of limited vertical extent so that combustion products flowing past the flow restriction are again disturbed in their flow upon passing the flow restriction and encountering an increased flow area of the flue path past the flow restriction.

The restriction of the area of the flue path around the outside of the tank followed by expansion of the flow area produces an improvement in the heat extraction efficiency. Although the precise mechanism and thermodynamics resulting in the improved efficiency are not known for certain, it is possible that at least one effect is occurring. The effects that produce or contribute to the heat extraction improvement include (i) the slowing of the average flow velocity through the entire flue path which can produce a greater residence time of combustion products within the water heater before being discharged. and (ii) the or each restriction is contributing to turbulence in the flow of combustion products which can increase the heat transfer efficiency. It is possible and perhaps even likely that both of these effects are contributing to an improvement in heat exchange efficiency.

In the preferred embodiment multiple flow restrictions are provided, e.g. three restrictions spaced apart in the direction of flow of combustion products so that the combustion products are repeatedly encountering the restrictions in passing from the burner before being discharged from the water heater.

Preferably the flow restrictions are provided no lower along the height of the tank than about one third to one half of the overall height up from the bottom. The extraction of heat from combustion products towards the lower portions of the tank is quite effective because the combustion products in that zone are hottest and also most turbulent. However as the combustion products travel further up the sides of the tank, they become cooler and the flow becomes less turbulent. The first restriction may be approximately at or above the mid-point in the height of the tank so as to restrict and disturb the flow pattern after the combustion products have travelled up and cooled significantly. As mentioned above preferably further flow restrictions are provided spaced above the first and before the combustion products reach the top of the tank.

In the case of a tank having cylindrical walls, the casing may define a flue path around the entire circumference of the tank. i.e. the flue path is substantially cylindrical. In this arrangement the flow restriction preferably in a cloud ring which extends inwardly from the casing so as to define a restricted flow area of annular shape in horizontal cross-section. The flow restriction may be defined by a formation constituting part of the casing. Alternatively the flow restriction may be defined by a body, such as ring or collar located within the casing and projecting inwardly therefrom towards the outside surfaces of the water tank. The flow restriction may restrict the flow area by in the order of 50% or more. For example if the radial width of the flue path is about 11 mm, the flow restriction ring or collar may extend inwardly by say 6.5 mm, leavinig a restricted flow passage of 4.5 mm radial width.

In the preferred embodiment, the flow restriction extending inwardly from the casing towards the outside surface of the tank also provides a tank centering formation which contacts the outside surface of the tank so as to thereby locate and maintain the tank relatively centered within the casing and so that the flue path is of uniform cross-sectional shape wherever a horizontal sectional view therethrough may be taken. The centering formations for example may comprise fingers, bosses or other projections which extend inwardly at points around the circumference of the flow restriction ring or collar and which contact the outside surfaces of the tank at points or small area contact zones around the circumference. The projections provide further restrictions to the flow although these are of relatively small dimension in the overall flow area at the flow restriction.

BRIEF DESCRIPTION OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DESCRIPTION OF THE PREFERRED EMBODIMENT

Figure 1:
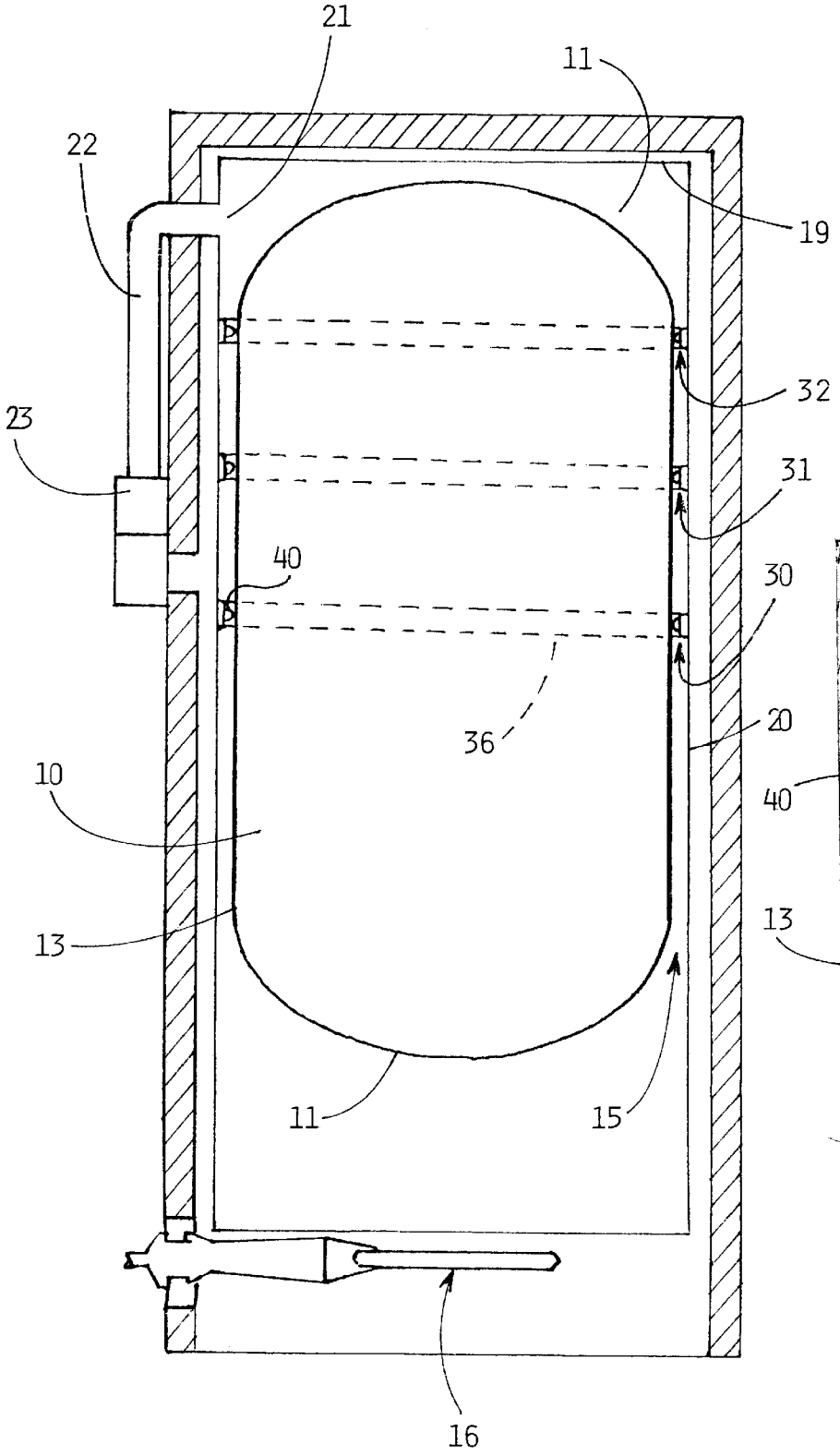
FIG. 1 is a side sectional view of a water heater embodying of the present inventions and FIG. 2 is a sectional view of the flow restricting ring used in the water heater of FIG. 1.

Referring to the drawings, the water heater includes a tank 10 for storage of water to be heated. The tank has a top 11 and bottom 12 which are domed, and has a cylindrical side wall 13. The tank may be made of stainless steel and provided with a usual components which are not illustrated, e.g a temperature probe and associated gas valve, conventional fittings including a cold water inlet, a hot water outlet at the top of the tank top 11 and a pressure and temperature relief port and associated valve positioned either at the top of the tank top 11 or near the top of the cylindrical side wall 13.

A burner 16 is located below the tank 10 and is spaced below the bottom 12. Combustion products from the burner 16 rise to contact the bottom 12 and to flow up through a flue path 15 which functions as a heat exchange zone which extends up the full height of the walls 13. The flue path 15 is defined by a casino 20 which surrounds the tank 10 and has a top 19 across the top 11 of the tank 10.

Near the top 19 of the casing 20 is a take off point 21 from where the combustion products pass through the downwardly extending flue passage 22 outside of the casing 20. The flue passage 22 passes down a significant distance (to provide a heat trap) and into a balanced flue outlet 23.

The water heater further includes flow restrictions 30, 31, 32 located in the flue path 15 and extending inwardly from the casing 20 towards the outside surface of the tank 10 and forming in generally horizontal section through the flue path 15 a region of restricted flow area so that the combustion products flowing up along the flue path encounter each flow restriction and are restricted and disturbed in flow pattern. Each flow restriction 30, 31, 32 is of limited vertical extent so that combustion products flowing past the flow restriction again are disturbed in their flow upon passing the flow restriction and encountering an increased flow area of the flue path. For example only, each flow restriction may be in the order of 30–50 mm in vertical extent.

In the illustrated embodiment, three flow restrictions 30, 31, 32 are provided spaced apart in the direction of flow of combustion products so that the combustion products are repeatedly encountering the restrictions in passing from the burner 16 before being discharged from the water heater through the flue 22. Preferably the flow restrictions 30, 31, 32 are provided no lower along the height of the tank 10 than about one third to one half of the overall height up from the bottom 11. The first restriction 30 is shown located approximately at the mid-point in the height of the tank 10 so as to restrict and disturb the flow pattern after the combustion products have travelled up and cooled significantly. As mentioned above further flow restrictions 31, 32 are provided spaced above the first restriction 30 and before the combustion products reach the top of the tank 11.

Figure 2:
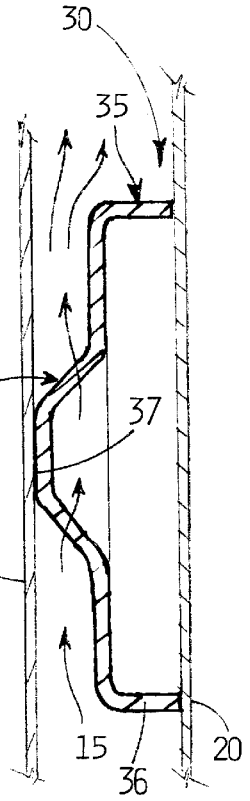

In the illustrated embodiment with a tank 10 having cylindrical walls, the casing 20 defines a flue path 15 around the entire circumference of the tank, i.e. the flue path 15 is substantially cylindrical. In this arrangement, the flow restrictions 30, 31, 32 extend inwardly from the casino 20 so as to define a restricted flow area of annular shape in horizontal cross-section. Each flow restriction may be defined by a formation constituting part of the casing 20. Alternatively, as in the illustrated embodiment, each flow restriction 30, 31, 32 is defined by a body 35, such as ring or collar 36 located within the casing 20 and projecting inwardly therefrom towards the walls 13 of the water tank 10. As shown in FIG. 2. the flow restriction restricts the flow area by in the order of 50% or more. For example, if the radial width of the flue path 15 is about 11 mm, the flow restriction ring or collar 36 may extend inwardly by say 6.5 mm, leaving a restricted flow passage of 4.5 mm radial width.

In the preferred illustrated embodiment, each flow restriction 30, 31, 32 extending, inwardly from the casing 20 towards the outside surface of the wall of the tank also provides a tank centering formation 40 which contacts the outside surface of the tank 10 so as to thereby locate and maintain the tank relatively centered within the casing 20 and so that the flue path 15 is of uniform cross-sectional shape wherever a horizontal sectional view therethrough may be taken. The centering formations 40 are shown as projecting bosses which are pressed inwardly from the material of the ring or collar 35. The bosses extend inwardly at points around the circumference of the flow restriction ring or collar 35 e.g. there may be ten bosses spaced around the circumference. The bosses contact the outside surfaces of the tank 10 at points or small area contact zones 37 around the circumference. The projections 40 provide further restrictions to the flow although these are of relatively small dimension in the overall flow area at the flow restriction.

The water heater described and illustrated herein provides a construction which enables an improved heat exchange efficiency compared to one having substantially the same configuration but without the flow restricting formations in the flue path between the casing and the tank walls.

I claim:

1. A water heater including a water tank having an outside surface and a lower portion thereof, a burner producing hot combustion products located at or towards the lower portion of the tank, a casing around at least part of the outside surface of the tank and spaced therefrom so as to define a flue path within the casing and along the outside surface of the tank whereby combustion products can flow along the outside surface of the tank and can therefore heat water within the tank, the water heater further including at least one flow restriction located in the flue path and extending inwardly from the casing towards the outside surface of the tank and forming in generally horizontal section through the flue path a region of restricted flow area whereby the combustion products flowing along the flue path encounter the flow restriction and are restricted and disturbed in flow pattern at said at least one flow restriction, said at least one flow restriction being of limited vertical extent so that combustion products flowing past the flow restriction are again disturbed in their flow upon passing the flow restriction and encountering an increased flow area of the flue path past the flow restriction, wherein there are a plurality of said flow restrictions provided, the flow restrictions being spaced apart in the direction of flow of combustion products so that the combustion products repeatedly encounter flow restrictions in passing along the flue path from the burner before being discharged from the water heater.

2. A water heater as claimed in claim 1, wherein a first one of said at least one flow restriction which is first encountered by the combustion products flowing upwardly from the burner along the lower portion of the outside surface and along the flue path is located at a position along the height of the tank no lower than one third of the overall height of the tank up to from the bottom of the tank whereby the lower portion of the tank over which combustion products are flowing are substantially completely exposed to the hottest and most turbulent combustion gases.

3. A water heater as claimed in claim 2 wherein said first flow restriction is located approximately at or above the mid point in the height of the tank so as to restrict and disturb the flow of combustion products after they have travelled up the outside surface of the tank and been cooled significantly by heat transfer to the tank.

4. A water heater as claimed in claim 1, wherein the tank has a cylindrical outside surface and the casing is cylindrical and defines a flue path around the entire circumference of the tank, and wherein said at least one flow restriction is a closed ring which extends inwardly from the casing so as to define a restricted flow area of annular shape in horizontal cross section through the flue path.

5. A water heater as claimed in claim 4, wherein said at least one flow restriction is defined by a formation constituting part of the casing.

6. A water heater as claimed in claim 4, wherein said at least one flow restriction is defined by a body located within the casing and projecting inwardly therefrom towards the outside surface of the water tank.

7. A water heater as claimed in claim 6, wherein said body comprises a ring which is generally U-shaped in vertical cross section and which has two opposed arms of the U-shape contacting the casing and the base of the U-shape is spaced inwardly from the casing and is facing and is spaced outwardly from the outside surface of the water tank.

8. A water heater as claimed in claim 4, wherein said at least one flow restriction extending inwardly from the casing towards the outside surface of the tank further has thereon a plurality of tank centering formations which contact the outside surface of the tank providing means for combustion products to flow past the at least one flow restriction so as to thereby locate and maintain the tank centered within the casing and so that the flue path is of uniform cross sectional shape wherever a horizontal cross sectional view therethrough is taken.

9. A water heater including a water tank having an outside surface and a lower portion thereof, a burner producing hot combustion products located at or towards the lower portion of the tank, a casing around at least part of the outside surface of the tank and spaced therefrom so as to define a flue path within the casing and along the outside surface of the tank whereby combustion products can flow along the outside surface of the tank and can therefore heat water within the tank, the water heater further including at least one flow restriction located in the flue path and extending inwardly from the casing towards the outside surface of the tank and forming in generally horizontal section through the flue path a region of restricted flow area whereby the combustion products flowing along the flue path encounter the flow restriction and are restricted and disturbed in flow pattern at said at least one flow restriction, said at least one flow restriction being of limited vertical extent so that combustion products flowing past the flow restriction are again disturbed in their flow upon passing the flow restriction and encountering an increased flow area of the flue path past the flow restriction, wherein the tank has a cylindrical outside surface and the casing is cylindrical and defines a flue path around the entire circumference of the tank, and wherein said at least one flow restriction is a closed ring which extends inwardly from the casing so as to define a restricted flow area of annular shape in horizontal cross section through the flue path, wherein said at least one flow restriction extending inwardly from the casing towards the outside surface of the tank further has thereon a plurality of tank centering formations which contact the outside surface of the tank providing means for combustion products to flow past the at least one flow restriction so as to thereby locate and maintain the tank centered within the casing and so that the flue path is of uniform cross sectional shape wherever a horizontal cross sectional view therethrough is taken, wherein each of said centering formations comprises a projection which extends inwardly and contacts the outside surface of the tank at a point or small area contact zone.

10. A water heater as claimed in claim 9, wherein said projection comprises a boss which is pressed inwardly from the flow restriction and contacts the outside surface of the tank at the point or small area contact zone.

11. A water heater as claimed in claim 9, wherein there are ten of said centering formations spaced around the circumference of the outside surface of the tank.

12. A water heater as claimed in 1, wherein said at least one flow restriction restricts the flow area of the flue path at the flow restriction by about 50% or more.

* * * * *